US006595519B1

(12) United States Patent
McGoveran

(10) Patent No.: US 6,595,519 B1
(45) Date of Patent: Jul. 22, 2003

(54) DIMENSIONAL PUZZLE

(76) Inventor: David O. McGoveran, 13150 Highway 9, Ste. 123, Boulder Creek, CA (US) 95006

( * ) Notice: Subject to any disclaimer, the term of this patent is extended or adjusted under 35 U.S.C. 154(b) by 0 days.

(21) Appl. No.: 09/450,537

(22) Filed: Nov. 30, 1999

(51) Int. Cl.[7] ..... A63F 9/06
(52) U.S. Cl. ..... 273/155; 273/109; 273/157 R
(58) Field of Search ..... 273/153 R, 155, 273/157 R, 109; 428/542.2

(56) References Cited

U.S. PATENT DOCUMENTS 3,758,981 A * 9/1973 Hlasnicek et al. ..... 273/109
3,884,462 A * 5/1975 Rebajes ..... 273/155
4,214,747 A * 7/1980 Rebajes ..... 428/542.2
4,384,717 A * 5/1983 Morris ..... 273/157
4,919,427 A * 4/1990 Keidar et al. ..... 273/155
5,324,037 A * 6/1994 Greeson ..... 273/155

* cited by examiner

*Primary Examiner*—Steven Wong
(74) *Attorney, Agent, or Firm*—George S. Cole

(57) ABSTRACT

A puzzle using Moebius topology and three-dimensional construction to make solution more challenging by preventing the player from seeing all possible layouts at any one time. The preferred embodiment of the puzzle challenges players to solve a maze when part of the maze will always be concealed by the current viewing surface, as the internal and external surface are both contiguous and identical.

7 Claims, 3 Drawing Sheets

DIMENSIONAL PUZZLE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

Puzzles incorporating mazes with two dimensions of movement (left-right, forward-back) are immensely popular and relatively inexpensive to design with modern computer layout tools, but suffer from two weakness. First, with existing two-dimensional mazes, a player may view the entire maze at once, unless a structure external to the maze is used to conceal some portion. Secondly, even with three-dimensional mazes adding an 'up-down' movement, relatively simple drawing techniques allow representation using only two dimensions. Thirdly, even when a two-dimensional maze is embodied in a three-dimensional object (such as a bracelet or ring) such that the far side of the puzzle is visually blocked by the near side, the player's mental visualization remains entirely two-dimensional, and the solution remains a two-dimensional function. A movable playing piece (flat and sliding, or spherical and rolling) often is used to move through the maze; and, to avoid falling off of the two-dimensional surface when three-dimensional movement occurs, both barriers and containing covers are used, the latter being typically transparent so as to not inhibit visibility. When the nature of the puzzle is to solve a maze, the dimensional simplicity is determined by the dimensions of movement rather than the dimensions of the maze's construction. These weaknesses mean that a player may mentally trace out a solution using a dimensional simplification that the maze's physical construction cannot obviate.

2. Description of the Related Art

Maze puzzles have been part of Western Civilization since Roman times. Before the American Revolution there were landscaped and tiled puzzles from Roman, Celtic, and British sources (several may be experienced within an easy half-day's travel of Bath, England). Mosaic-solution puzzles are of more recent origin, popularly recognized as starting with the introduction of the Rubik's Cube in the 1970's. (However much mosaic layout problems may have presented architectural challenges to the fresco designers of the Avalon Casino on Santa Catalina, or to generations of bathroom tile layers, they were not seen as general amusements.) The 1980's saw a revival in interest in landscape puzzles as popular amusement, leading to the construction of many such in two or even three dimensions, including among such the 'Wooz' maze and amusement park located near Sacramento, Calif.

Creating a maze with two dimensions of movement can be done on a two-dimensional surface (with length l and width w) (FIG. 1) of a three-dimensional object such as a sheet of paper, plastic, or other flexible or formed material. A corresponding maze (also with length l and width w) (FIG. 2) may be drawn on the opposite side of the three-dimensional object. Each maze may be viewed completely by a view perpendicular to its surface, the l-w plane.

Topological quandaries posited by Moebius and Felix Klein (1849–1925) have inspired mathematicians and artists but otherwise had little attention paid to how they might be useful or instructive. Three-dimensional and two-dimensional puzzles have been perceived as entirely separate and distinct areas of inventive effort and gameplay.

Puzzles have been viewed as a means for both enjoyment and increasing intellectual ('puzzle-solving') capacities. And the topological insights of Moebius and Klein have been viewed as curious, but hardly relevant, mathematical truths. But deliberately mixing surface and dimensional complexity through design and manufacture that focuses on special topological characteristics, and doing so in a fashion that will encourage playful use as a way to foster n-dimensional visualization, is the essence of this invention. This embodiment of the invention allows even preschool youngsters the opportunity to perceive mathematical complexities usually only first encountered in high school.

BRIEF SUMMARY OF THE INVENTION

A n-dimensional puzzle can be laid out and then, througha (N+1)-dimensional physical manipulation using the specific topological technique of making a unitary topological surface out of previously separated surfaces by incorporating an odd number of 180° inversions or twists and joining the previously-separated parallel edges, be turned into an three-dimensional puzzle, whose solution requires visualization of three-dimensional movement from the start to the finish, even though the current state of the progression through the maze can always be viewed as a two-dimensional problem. This third-dimensional manipulation guarantees that at any point along the puzzle its apparantly opposing side will be hidden by that portion of the surface that is currently visible, and that accurate visualization of the dimensions of movement must include the current and final positions. The preferred embodiment of this invention is a maze puzzle in a Moebius ring, in which a moving marker piece may be used to let a player track his progress through the maze embodied in the puzzle. To prevent the moving piece from falling out during the three-dimensional manipulation by the player, the maze occupies only a portion of the flexible material's surface and the rest is transparent and used to form an edge wall and top cover.

BRIEF DESCRIPTION OF THE SEVERAL VIEWS OF THE DRAWINGS

This embodiment of the invention will be better understood with reference to drawings illustrating a preferred embodiment, in which:

FIG. 2 is the 'flip' or opposite side of FIG. 1, the corners appear inverted in FIG. 2 (2*b* over 2*a*, 2*d* over 2*c*).

Between the third and sixth squares from the left-hand or beginning edge of the single sheet of flexible material a hole has been punched through from Side 1 to Side 2, and is labeled as such in each figure.

Corner 1*a* has, from the top down, one blocked and three open squares. Corner 1*b* has, from the bottom up, three blocked squares and one open square. Corner 1*c* has, from the top down, 1 open and three solid squares. Corner 1*d* has, from the bottom up, two open and two blocked squares. Corner 2*a* has, from the bottom up, 2 open, 1 blocked, and 1 open square. Corner 2*b* has, from the top down, 1 open, 1 blocked, and 2 open squares.

Figure 1:
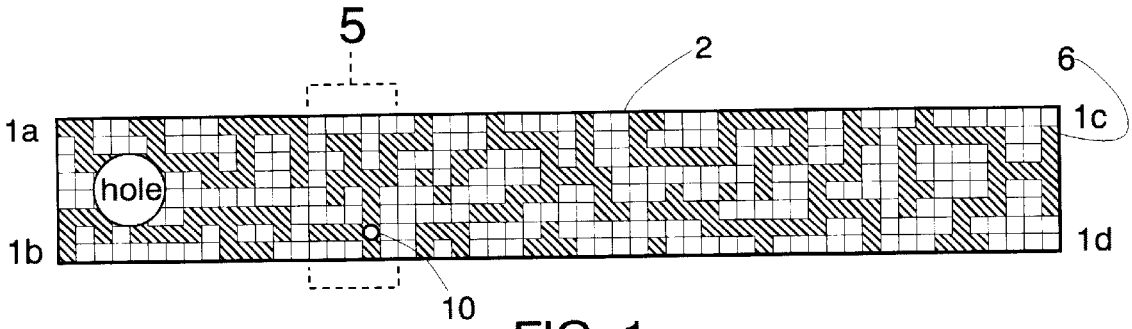
FIG. 1 and FIG. 2 are Side 1 and Side 2 (or the 'top' and 'bottom' sides) of a single sheet of flexible material (which is of necessity a three-dimensional object having a side and two surfaces) on which a two-dimensional maze has been laid out. The gray shading shows areas blocking motion; the white squares show open space through which movement is possible. The four corners of the single sheet of flexible material are labeled from the top left going counterclockwise a,b,c, and d; so the four corners on FIG. 1 become 1*a,* 1*b,* 1*c,* 1*d;* and the four corners on FIG. 2 become 2*b,* 2*a,* 2*c,* and 2*d.* The drawing shows the preferred embodiment's first phase, where the single sheet is rectangular, with two pairs of parallel edges, with the pair furthest separated from each other denoted as the beginning edge (a–b) and ending edge(c–d). On FIG. 1 item 2 marks the a–c or 'top' edge at a point where the maze is open, while item 6 marks the c–d edge at a point where the maze is blocked. On FIG. 2 item 4 marks the b–d or 'bottom' edge at a point where the maze is blocked, and item 8 marks the a–b edge at a point where the maze is blocked. Because
Figure 2:
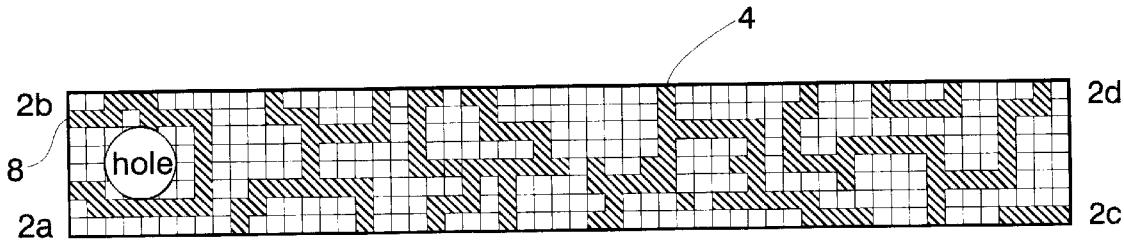
Figure 3:
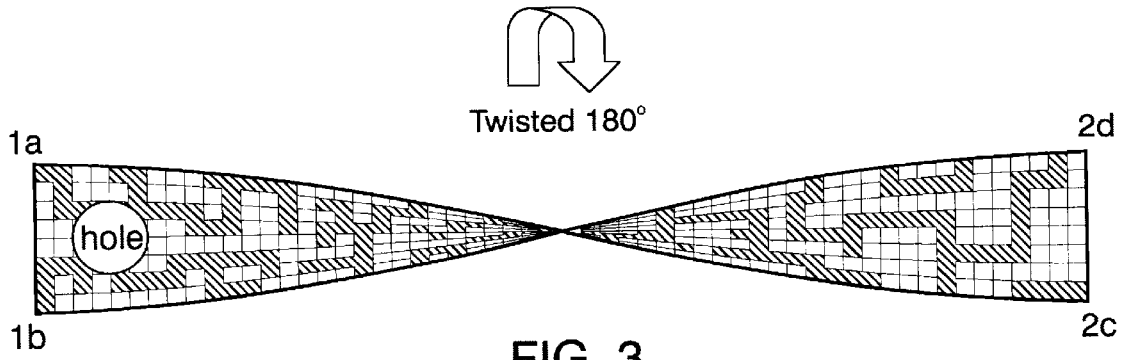

FIG. 3 shows the process of twisting the single sheet of flexible material 180° in the abcd plane (the Moebius twist). Corners 1*a* and 1*b* remain on the left side of the figure, while corners 2*c* and 2*d* are now visible on the right side of the figure. Note that 2*a*,2*b* and 1*c*, 1*d* are no longer visible as they are concealed by the opposite side. The visible corners mark where the single sheet of flexible material will be joined together.

Figure 4:
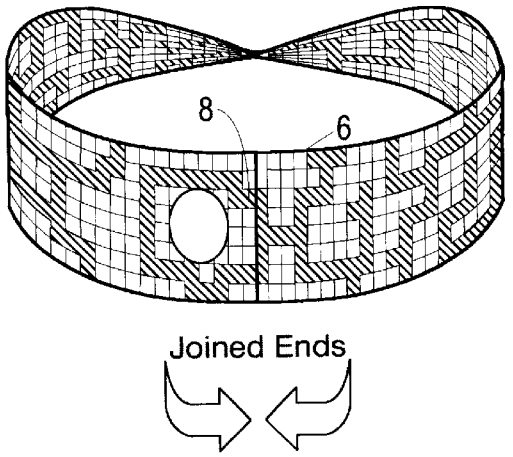

FIG. 4 shows the assembled puzzle, after the two ends are joined. Corners 1*a* and 2*d* (inverted), and 1*b* and 2*c* (inverted) are joined, which means that corners 1*d* (inverted) and 2*a*, and 1*c* (inverted) and 2*b*, are joined. Looking at the left edge of the join and counting down there are 2 open, 1 blocked, and 1 open squares (Corner 2*a*); then 2 open, 1 blocked, and 1 open squares (Corner 2*b*); looking at the right edge of the join and counting down there are 2 open, 2 blocked squares (Corner 1*d*); then 3 blocked, 1 open squares (Corner 1*c*). The hole is visible but the 'far' side (in this case, 1*a* and 1*b*) is not visible.

FIG. 4 also shows that the hole (seen from the perspective of 2*b*,2*a*) now has a few open squares around it which are in turn surrounded by solid lines, meaning that it is only accessible from the 'other side'. The blocking line came from edge 1*d* and 1*c* (inverted), which was not originally visible before construction. This represents the type of surprise combination that this embodiment of the invention makes possible from the Moebius twist construction.

FIG. 4 further shows that at any part of the surface of the maze half or more of the puzzle is concealed from the viewer by the puzzle's structure, even though all of the puzzle may be openly viewed (by simply rotating the puzzle through the third dimension).

Figure 5:
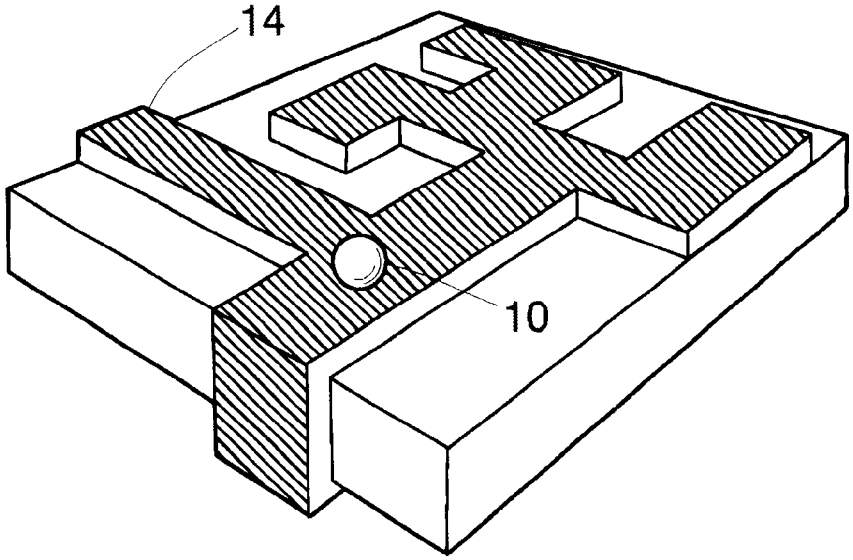

FIG. 5, an expanded view of a portion of the flexible sheet, shows in greater detail and with three-dimensional depth a portion of the maze, where the paths of allowable motion are both demarcated in grey (14) and raised above the areas (demarcated in white) where motion is not allowed. It also shows the movable playing piece (10), in this case represented as a ball, though it could equally be a flat, sliding marker, resting on the raised portion of the maze along which motion is permitted.

Figure 5A:
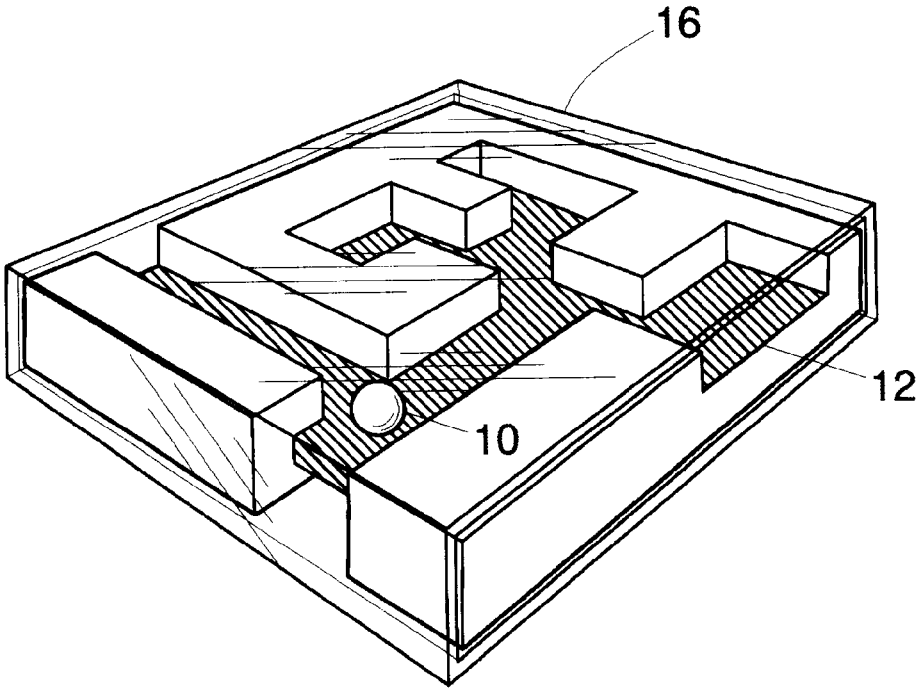

FIG. 5A shows in greater detail and with three-dimensional depth a portion of the maze, where the paths of allowable motion are both demarcated in grey (14) and incised into the areas (demarcated in white) where motion is not allowed. It also shows the movable playing piece (10), a side wall (12), and a transparent top sheet (16) to contain the movable playing piece within the maze.

The particular pattern of the maze shown in the drawings is exemplary rather than particular to the invention; any 2-dimensional maze pattern could exist.

DETAILED DESCRIPTION OF THE INVENTION

By using a special topological characteristic,ascribed to Augustus Ferdinand Moebius (1790–1868), and designing a maze on an n-dimensional surface that uses the Nth+1 dimension of the object having such surface (e.g., rotating a two-dimensional maze through the third dimension during construction), these two weaknesses are no longer present. The special topology of the completed dimensional puzzle prevents a player's visualization from being dimensionally simpler than the puzzle's actual construction. The key element in the design and construction is to ensure that the actual physical object incorporating the maze has a topology of N+1 dimensions and a maze laid out on a surface having only N dimensions, which means that formerly disparate surfaces of the object become both contiguous and unitary, that is, that the two surfaces are in fact one since they are topologically identical. The commonest example of this is referred to as a 'Moebius strip'; the more complex example is a 'Klein bottle'.

For example, a two-dimension-of-movement maze (drawn on a sheet of paper or a computer screen) can first be constructed. This two-dimension-of-movement maze then is incorporated in a three-dimensional object (such as a bracelet or ring), that has the third dimension and special topological characteristic added during construction by twisting the end 180° through the third dimension before joining it to the beginning (the Moebius twist). Dimensional complexity of the puzzle can be further increased by adding one or more holes through the surface to connect through a dimensional shortcut apparently 'opposing' sides. (Apparently opposing, because one of the functions of the Moebius twist is to create a three-dimensional object with a single surface and a single edge.) The twist-and-connection creates out of two previously opposing surfaces one continuous and double-length surface having only one continuous edge. This means that at any point along the puzzle the opposite side will be concealed from the player, preventing him from ever viewing the entire puzzle at once. Moving through and solving the puzzle thus requires three-dimensional visualization to avoid reversing one or both of the left-right, forward-back directions currently visible due to the rotation and/or shortcut hole.

By constructing the three-dimensional object in such a way that twists the two-dimensional surface 180° in the third dimension, thus inverting the second edge (measuring along one dimension, such as length l) compared to the first edge (so a–b lines up with d–c, respectively; FIG. 3), and combines the upright and inverted edges together (meshing a to d, b to c), a single conjoined maze of length 2l is created (FIG. 4). In this fashion, a maze of length 2l with width w can be created on a Moebius strip, wherein the front and back surfaces of the maze are topologically identical though differentiated by the portion of the total maze that they incorporate.

Similarly, a three-dimensional object with an inner surface and an outer surface, each of which has a maze of two dimensions, each surface having the same two dimensions, can be created wherein one surface is twisted and joined to the other such that the two surfaces are topologically identical, as in a Klein bottle.

Any such N+1 dimensional object with an N dimensional maze has the special characteristic that the conjoined maze can never be viewed in its entirety from any point perpendicular to its surface, since the N+1 dimensional complexity ensures that the surface itself blocks observation of the 'opposite' side. Moreover, any attempt to visualize the complete maze solution requires both three-dimensional visualization and tracking the orientation of the beginning, current process, and end points to avoid confusing the correct two-dimensional movement towards the solution at each point.

Unlike the simple observational puzzle comprised of at least two juxtaposable Moebius rings in Keldar, I. et. al., U.S. Pat. No. 4,919,427, this invention requires only a single, unique construct. Furthermore, it is extendible to a three-dimensional object (such as a Klein bottle) for which no possible construction can be had for the Keldar invention.

Unlike the cylindrical puzzle disclosed in Blankenburg, K., U.S. Pat. No. 5,116,053, where the cylinder has only one surface but two edges (a top and bottom one, specifically claimed as the first and second opposed ends), this invention has only one external edge (by nature of the inclusion of the Moebius twist), thereby doubling the difficulty of locating the proper position for any 'edge' piece. The geometrical nature of this invention, rather than the construction and means for motion of the pieces comprising the puzzle detailed in Blankenburg, distinguish the two.

This puzzle is a single, integrated, three-dimensional puzzle in terms of its solution however much it is a two-dimensional puzzle at any point, unlike the interacting yet separate puzzles in Clancy, U.S. Pat. No. 4,333,652.

This puzzle can be constructed from a single unitary piece of flexible material, and derives its concealment of the solution from direct perception by its geometric peculiarity, unlike the multiple-piece, internally-concealed elements described in Kuo, U.S. Pat. No. 5,205,557.

This puzzle can be constructed from a single unitary sheet of flexible material. On one-half of each side of the sheet a two-dimensional maze pattern can be inscribed, in such fashion that when the sheet as awhole is given any odd number of 180 degree twists and the shorter sides subsequently are joined together, the uninscribed portion of the sheet remains transparent and serves, when folded over, as both the single edge wall and cover to the two-dimensional pattern, with the height of said edge wall being no more than necessary to allow the motion of a game piece or ball within. The consequential three-dimensional puzzle structure has a now joined two-dimensional maze on a single surface This puzzle requires orientation of the entire puzzle, rather than individual segments, through three dimensions to reach a proper solution, and can be solved by concentrated three-dimensional visualization without actual physical manipulation, unlike the ball-in-track puzzle described in Harris, U.S. Pat. No. 5,645,78.

Every portion of the puzzle may be viewed (thought not all at one time), unlike the hidden maze passages described in Watanabe, U.S. Pat. No. 4,861,036.

In the preferred embodiment there is movable playing piece which is used to track the motion through the maze, and an edge piece and a second, transparent top sheet matching the maze-bearing object, which together form a third dimensional barrier and are attached to the maze-bearing object to prevent the movable playing piece from falling 'off' the surface of the maze during three-dimensional motion of the object.

I claim:

1. A puzzle comprising:

a single sheet of material, having a beginning edge and an ending edge parallel to each other, formed into a closed loop wherein said single sheet of material has a single surface and a single side, by incorporating into the loop an odd number of 180° twists between the beginning and ending parallel edges of said single sheet of material, with said beginning and parallel edges being joined together, enclosing a space wherein a movable playing piece may be fitted; and, demarcation on said single sheet of material that differentiates between areas across which motion is allowable and across which motion is not allowable, thereby forming a two-dimensional maze on said single sheet of material.

2. A puzzle as in claim 1, wherein said demarcation is comprised of markings on said single surface of said single sheet of material.

3. A puzzle as in claim 2, wherein said demarcation is comprised of three-dimensional barriers to motion on said single surface of said single sheet of material.

4. A puzzle as in claim 3, wherein said three-dimensional barriers to motion on the surface of said single sheet of material are raised above said single surface.

5. A puzzle as in claim 3, wherein said three-dimensional barriers to motion on the surface of said single sheet of material are incised into the surface.

6. A puzzle as in claim 1, further comprising:

the existence in the single sheet of material of a hole that connects one side of said single sheet of material to the other through said surface.

7. A puzzle as in claim 1, further comprising:

an edge piece along parallel sides of said single sheet of material forming an external barrier to sideways motion off said single sheet of material;

a second top sheet, identically shaped and twisted as said single sheet of material, and attached to said edge piece so as to form an external barrier to outward motion off said surface of said single sheet of material; and, a movable playing piece, that serves to track the motion within the maze, sized to fit between said single sheet of material and said second top sheet and just through the narrowest width of any part of the two-dimensional maze along which motion is allowed.

* * * * *